US007464732B2

(12) United States Patent
Nishino et al.

(10) Patent No.: US 7,464,732 B2
(45) Date of Patent: Dec. 16, 2008

(54) FILLING VALVE

(75) Inventors: Yukinobu Nishino, Kanazawa (JP); Shinya Kamori, Kanazawa (JP); Tooru Shimode, Kanazawa (JP); Kenichi Tsukano, Kanazawa (JP)

(73) Assignee: Shibuya Kogyo Co., Ltd., Kanazawa-Shi, Ishikawa-Ken (JP)

( * ) Notice: Subject to any disclaimer, the term of this patent is extended or adjusted under 35 U.S.C. 154(b) by 414 days.

(21) Appl. No.: 11/287,848

(22) Filed: Nov. 28, 2005

(65) Prior Publication Data

US 2006/0113002 A1 Jun. 1, 2006

(30) Foreign Application Priority Data

Nov. 30, 2004 (JP) ..... 2004-346538

(51) Int. Cl.
*B65B 31/00* (2006.01)

(52) U.S. Cl. ..... 141/57; 141/144; 141/145; 141/286

(58) Field of Classification Search ..... 141/57, 141/144–147, 286, 392; 222/189.09
See application file for complete search history.

(56) References Cited

U.S. PATENT DOCUMENTS

| | | | | |
|---|---|---|---|---|
| 2,887,133 | A | 5/1959 | Breeback | |
| 4,442,873 | A * | 4/1984 | Yun | 141/39 |
| 4,750,533 | A * | 6/1988 | Yun | 141/46 |
| 5,145,008 | A * | 9/1992 | Yun | 141/39 |
| 5,193,593 | A * | 3/1993 | Denis et al. | 141/10 |
| 5,884,677 | A * | 3/1999 | McKaughan | 141/145 |
| 6,112,778 | A * | 9/2000 | Nish et al. | 141/6 |
| 6,131,624 | A * | 10/2000 | Paradies | 141/286 |
| 6,817,386 | B2 * | 11/2004 | Tsukano et al. | 141/57 |

FOREIGN PATENT DOCUMENTS

| | | | |
|---|---|---|---|
| DE | 1782402 | A1 | 8/1971 |
| EP | 0850838 | A1 | 7/1998 |
| JP | 2004-136927 | A | 5/2004 |
| JP | 2004-217246 | A | 8/2004 |
| WO | WO 00/51932 | A | 9/2000 |

* cited by examiner

*Primary Examiner*—Timothy L Maust
(74) *Attorney, Agent, or Firm*—Flynn, Thiel, Boutell & Tanis, P.C.

(57) ABSTRACT

A valve housing which is internally formed with a filled liquid passage and a liquid valve which allows or interrupts a communication of the filled liquid passage are provided, and a liquid valve opening/closing air cylinder opens or closes the liquid valve to perform a filling operation of a filled liquid. An outlet portion located at the bottom end of the valve housing is formed by a separate liquid outlet member. A first liquid outlet member which is connected with a gas exhaust passage and used for a carbonated filling operation and a second liquid outlet member which carries a screen on its bottom end and used for a non-carbonated filling operation are interchangeably used. A filling valve which permits a combined use with a carbonated filling operation and a non-carbonated filling operation enables an accommodation for a filling operation which should take place in a clean environment.

3 Claims, 4 Drawing Sheets

FILLING VALVE

BACKGROUND OF THE INVENTION AND RELATED ART

The present invention relates to a filling valve which permits a combined use in a filling of a carbonated beverage and a filling of a non-carbonated beverage, and in particular, to a filling valve which is suitable for a filling operation under a clean environment.

A filling valve which permits a combined use in a filling of a carbonated beverage and a filling of a non-carbonated beverage is known in the art (see, for example, Japanese Laid-Open Patent Application No. 2004-136927). The filling valve disclosed therein comprises a valve housing which is centrally formed with a filled liquid passage communicating with a filled liquid supply piping extending from a tank of filled liquid and which includes a bottom end in which a filling nozzle is mounted. A communication of the filled liquid passage is allowed or interrupted by opening or closing a liquid valve. The filling valve also comprises a bottle mouth gasket which seals the mouth of a vessel during a filling operation, an air cylinder for moving the bottle mouth gasket up and down, a flow meter which detects the quantity of liquid filled into the vessel, and a gas exhaust passage formed within the valve housing.

In the filling valve, an opening of the gas exhaust passage is located outside an opening (liquid discharge port) of the filling valve, and when a carbonated filling operation is to take place, a liquid is filled into the vessel through the filling nozzle from the filled liquid passage which is centrally formed within the value housing while the mouth of the vessel is sealed by the bottle mouth gasket and while exhausting gas within the vessel through the gas exhaust passage which is formed outside the filled liquid passage.

In an arrangement as in the filling valve disclosed in the above citation in which a gas exhaust passage, a counter-passage and the like are formed within the valve housing, it is difficult to form these passages in a linear alignment, but the passages must be folded in different directions. During manufacture, a plurality of bores are formed into the valve housing in different directions so that they can communicate with each other within the housing, and pins are forced into undesired portions as a press fit to block such bores. With this arrangement, there arises a risk that fungus beds may form in clearances formed between pins which are disposed as a press fit and internal surfaces of bores formed in the valve housing, and therefore, this technique is inapplicable when the filling operation should take place in a clean environment.

For a filling operation of a non-carbonated beverage, it is an extensively applied practice to attach a screen to the distal end of the nozzle for purposes of suppressing a formation of bubbles and removing foreign matters. However, it is a time taking operation to attach screens to a number of nozzles. Accordingly, it may be contemplated to replace the nozzles by those which have screens attached to the distal end thereof. However, when the gas exhaust passage is formed within the housing, there remains the gas exhaust passage in the housing if the nozzles are changed alone, requiring a cleansing and a sterilization of such locations. This is undesirable in an arrangement which performs a filling operation in a clean environment where the number of locations which must be cleansed should be reduced as much as possible.

SUMMERY OF THE INVENTION

Accordingly, it is an object of the present invention to provide a filling valve which permits a combined use in a filling of a carbonated beverage and a filling of a non-carbonated beverage and which can accommodate for a filling operation in a clean environment.

The object is accomplished by providing a filling valve including a valve housing which is internally formed with a filled liquid passage and a liquid valve which opens or closes the filled liquid passage in order to fill a liquid into a vessel supplied. The valve housing comprises a body and a liquid outlet member which is separate from and which can be detachably mounted on the lower end of the body, allowing a choice from a first liquid outlet member which is connected to a gas exhaust passage and a second liquid outlet member having a screen attached to its lower end to be mounted thereon.

In accordance with the invention, a gas exhaust passage is not provided within the valve housing, and when a carbonated filling operation is to be performed, the first liquid outlet member which is connected to the gas exhaust passage is mounted. Alternatively, for a non-carbonated filling operation, the second liquid outlet member having a screen attached to its lower end is mounted. In this manner, there is obtained a filling valve which permits a combined use with a carbonated beverage and a non-carbonated beverage and which can accommodate for a clean environment.

DETAILED DESCRIPTION OF PREFERRED EMBODIMENT

Figure 1:
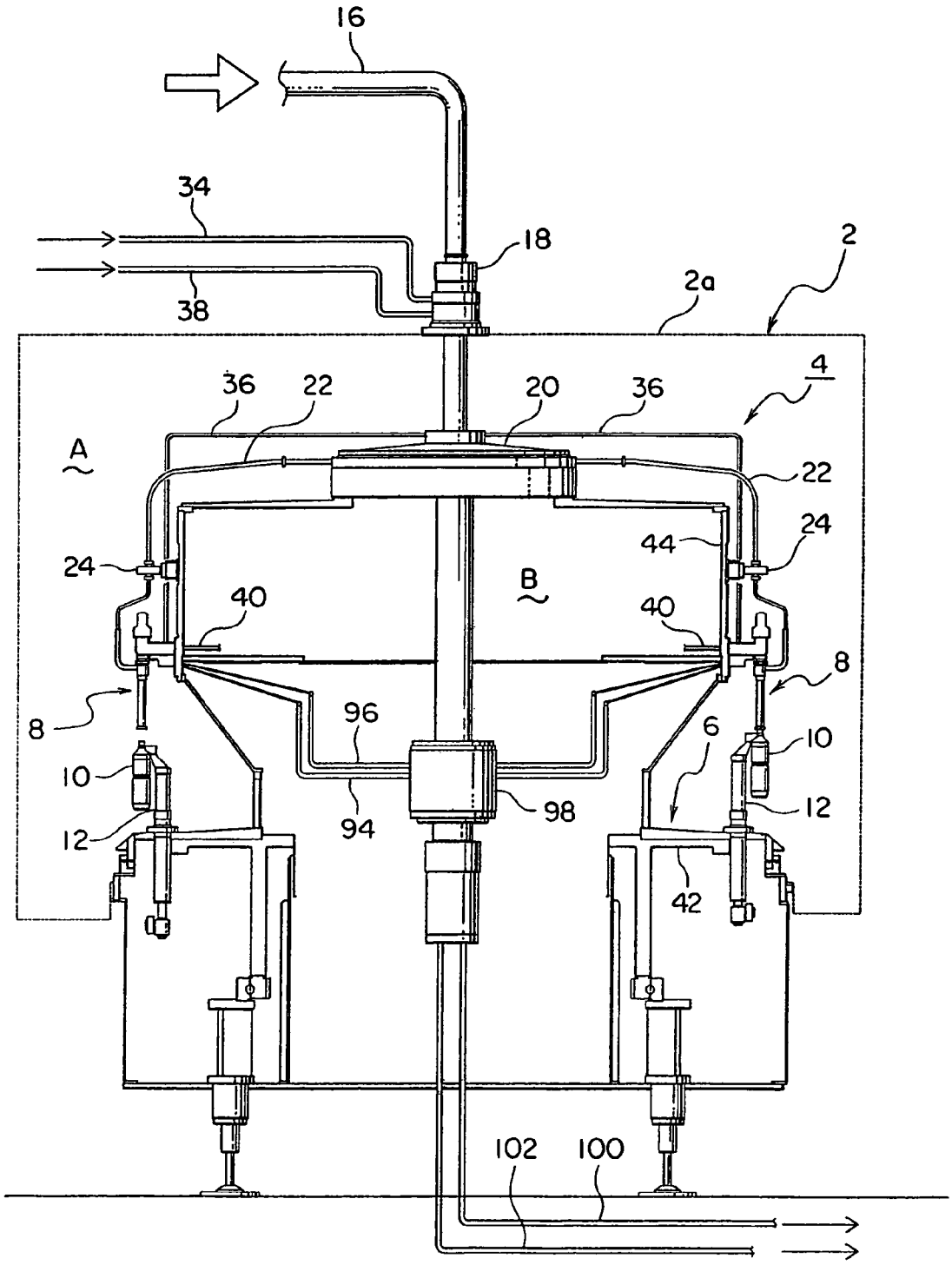
FIG. 1 is a longitudinal section showing an overall arrangement of a filler including a filling valve according to one embodiment of the present invention.

An embodiment of the present invention shown in the drawings will now be described. A filler including the filling valve according to the present embodiment comprises a rotary filler body, generally indicated by numeral 4, disposed within a space which is enclosed by a stationary external wall 2 and purified to a high level, and a reservoir tank of filled liquid, not shown, disposed outside the external wall 2 for supplying a filled liquid to the rotary filler body 4.

The filler body 4 includes a plurality of filling valves 8 disposed around the outer periphery of a revolving body 6 at an equal interval circumferentially. Disposed below each filling valve 8 is a vessel holding means 12 which holds and elevates a vessel 10, the vessel holding means 12 elevating the vessel 10 which it holds while rotating integrally with the filling valve 8 and while maintaining a vertical alignment therewith. In the present embodiment, the vessel 10 into which a liquid is to be filled comprises a resin vessel of a light weight such as PET bottle, and is elevated while the neck of the vessel 10 is held suspended by the vessel holding means 12. The liquid which is filled into the vessel 10 through the filling valve 8 may be a beverage which is charged with a carbon dioxide or a beverage which does not contain a gas.

A reservoir tank of filled liquid is installed outside the external wall 2 in a manner separated from the filler body 4 which is disposed inside the external tank 2. A liquid supply pipe 16 extending from the reservoir tank is connected through a top rotary joint 18 which is fixedly mounted on the top surface 2*a* of the external wall 2 to the rotary filler body 4 for supplying a filled liquid thereto. The filled liquid which is supplied is branched by a liquid supply manifold 20 into a plurality of liquid supply pipes 22, which are equal in number to the number of the filling valves 8, to be fed to each filling valve 8. A flow meter 24 is disposed in each liquid supply pipe 22 to detect the flow rate of the filled liquid which is supplied to the filling valve 8 through the liquid supply pipe 22 to be filled into the vessel 10.

The filler of this embodiment represents a filler which permits a combined use with a carbonated filling operation and a non-carbonated filling operation, and accordingly, a counter gas supply pipe 34 extending from a source of pressurized gas (which is $CO_2$ gas in this embodiment) is connected to the top rotary joint 18, thus allowing $CO_2$ gas to be supplied to the filler body 4. $CO_2$ gas which is supplied to the filler body 4 through the gas supply pipe 34 is fed to each filling valve 8 through individual pressurized gas pipes (counter gas pipes) 36 which are branched from the top rotary joint 18. In addition, an air supply pipe 38 connected to a source of pressurized air allows a pressurized air to be supplied to the filler body 4 through the top rotary joint 18. Specifically, the air is fed through each filling valve 8 through individual air supply pipes 40 which are branched from the top rotary joint 18. It is to be noted that the air which is fed to the filling valve 8 operates an air cylinder which opens or closes a liquid valve for allowing or interrupting a communication of the filled liquid passage formed within the valve housing of the filling valve 8. The air is also utilized for opening and closing a counter gas valve, a gas exhaust valve and a snifter valve.

The vessel holding means 12 which holds and elevates the vessel 10 is mounted on a turntable 42, and an isolation wall 44 which partitions inside and outside of the filler body 4 is disposed in a region from the inner periphery of the turntable 42 to the lower surface of the liquid supply manifold 20 disposed thereabove. The isolation wall 44 provides a partition between a space A or a space having a clean, sterilized environment and located toward the external wall 2 through which the filling valve 8 and the vessel 10 carried by the vessel holding means 12 rotate to perform a liquid filling operation, and a non-sterilized space B which is located inside the revolving body 6.

Figure 2:
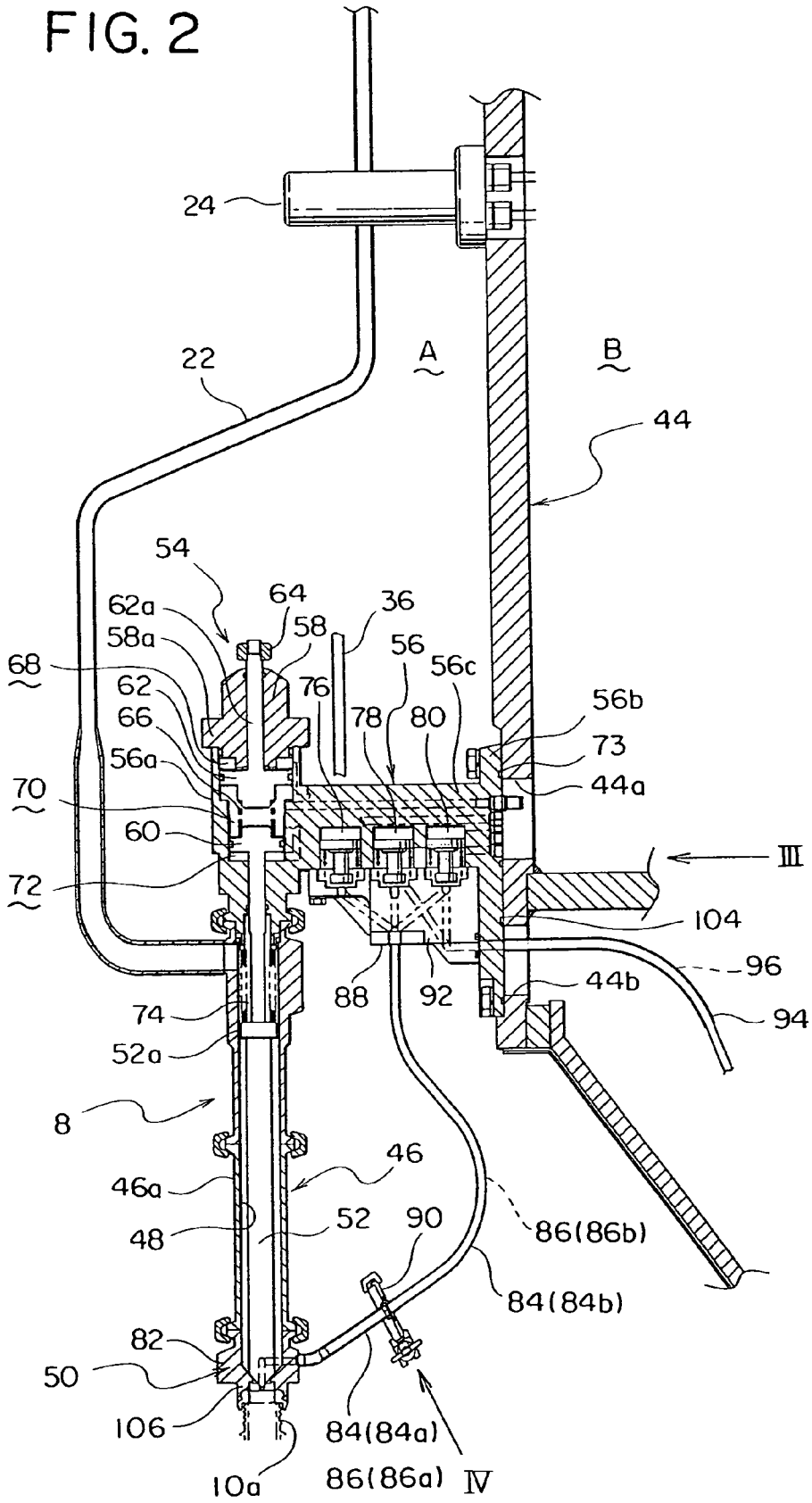
FIG. 2 is an enlarged view of a mounting portion of the filling valve, and is a longitudinal section illustrating a liquid outlet member for a carbonated filling operation mounted on the valve housing.
Figure 3:
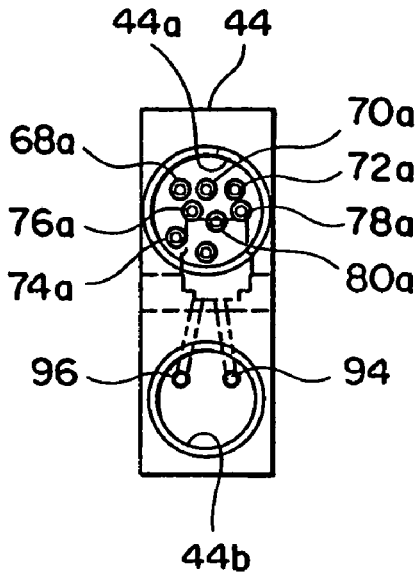
FIG. 3 is a view, as viewed in a direction indicated by an arrow III shown in FIG. 2.
Figure 4:
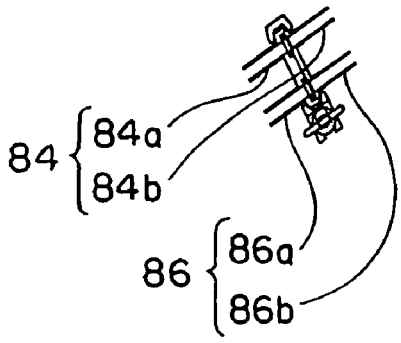
FIG. 4 is a view, as viewed in a direction indicated by an arrow IV shown in FIG. 2.

The arrangement of the filling valve 8 will now be described with reference to FIGS. 2 to 4. The filling valve 8 has a valve housing 46 which is internally formed with a filled liquid passage 48, whereby a filled liquid from the reservoir tank is fed through a liquid supply pipe 16, the top rotary joint 18, the liquid supply manifold 20 and through the liquid supply pipe 22 to each filling valve 8, and thence through the filled liquid passage 48 to be filled into the vessel 10.

A liquid valve 50 is disposed within the valve housing 46 to allow or interrupt a communication of the filled liquid passage 48. The liquid valve 50 comprises a valve element which is formed on the bottom end of a rod 52 which elevatably extends through the filled liquid passage 48, and a valve seat formed on the internal surface of the filled liquid passage 48 at its bottom end. The elevating rod 52 having the valve element is elevated by the actuation of a liquid valve opening/closing air cylinder 54 which is mounted on a top portion of the valve housing 46.

The construction of the liquid valve opening/closing air cylinder 54 will be described briefly. A filling valve mounting block 56 having a cylinder 56*a* which is coaxial with the valve housing 46 is secured above the valve housing 46 which is cylindrical, and a flange 58*a* of a cylindrical member 58 is secured in the top opening in the cylinder 56*a*. A space which has a greater diameter in its top portion and a reduced diameter toward the bottom is defined within the cylinder 56*a*.

A first piston 60 of a reduced diameter is mounted on the top end of the elevating rod 52, and is slidably fitted into the bottom portion of the space mentioned above which has a reduced diameter while a second piston 62 having a greater diameter than the first piston 60 is slidably fitted into the top portion of the above mentioned space which has a greater diameter. The second piston 62 has a rod 62*a*, which extends through the cylindrical member 58 to project thereabove, with a stop 64 which defines the limit of descent of the second piston 62 being mounted on the projecting end. A spring 66 is disposed between the first piston 60 which is located downward and the second piston 62 which is located upward to urge them away from each other (in a vertical direction).

The internal space within the cylinder 56*a* is divided by the first and the second pistons 60 and 62 into a first pressure chamber 68, a second pressure chamber 70 and a third pressure chamber 72, as viewed sequentially from above. These pressure chambers 68, 70 and 72 are connected to a source of compressed air through internal air passages 68*a*, 70*a* and 72*a*, respectively, which are formed in the filling valve mounting block 56 and through the air supply pipe 40, thus allowing the air to be supplied to or exhausted from these chambers by a switching operation of a valve. The isolation wall 44 on which the filling valve mounting block 56 is secured is formed with a circular communication opening 44*a*, and the internal air passages 68*a*, 70*a* and 72*a* which supply or exhaust the air to or from the respective pressure chambers 68, 70 and 72 open into the communication opening 44*a* (see FIG. 3). A seal ring 73 is mounted between a flange 56*b* of the filling valve mounting block 56 and the outer periphery of the communication opening 44*a* in the isolation wall 44 to maintain a hermetic seal.

When the first pressure chamber 68 which is located upward and the third pressure chamber 72 which is located downward are made open to the atmosphere while a compressed air is introduced into the second pressure chamber 70 which is located intermediate therebetween by utilizing the internal air passages 68*a*, 70*a* and 72*a*, the second piston 62 which is located upward ascends while the first piston 60 which is located downward descends, whereby the valve element which is formed on the bottom end of the elevating rod 52 becomes seated on the valve seat which is formed on the lower end of the filled liquid passage 48 to close the liquid valve 50. On the other hand, when the first pressure chamber 68 which is located upward and the second pressure chamber 70 which is located intermediate to other pressure chambers are made open to the atmosphere while the compressed air is introduced into the third pressure chamber which is located downward, the first piston 60 which is located downward ascends and also drives the second piston 62 upward, whereby the first piston 60 which is located downward ascends to its highest position. At this time, the valve element formed on the bottom end of the elevating rod 52 is largely spaced from the valve seat, opening the liquid valve 50 with a greater opening to allow a filling operation to take place at a greater flow rate. Finally, when the compressed air is introduced into the first pressure chamber 68 which is located upward and the third pressure chamber 72 which is located downward while the intermediate second pressure chamber 70 is made open to atmosphere, the second piston 62 which is located upward descends while the first piston 60 which is located downward ascends. However, the first piston 60 which is located downward has a pressure responsive area which is less than that of the second piston 62, and its limit of ascent is limited by the decent position of the second piston 62 which is defined by the stop 64, whereby the liquid valve 50 is opened at a reduced opening, allowing a filling operation to take place at a reduced flow rate.

It is to be noted that bellows 74 are mounted between an upper surface of the filled liquid passage 48 within the valve housing 46 and the upper portion 52*a* of the elevating rod 52 to provide a perfect isolation between a region including the filled liquid passage 48 where a liquid such as beverage flows and a region including the liquid valve opening/closing air cylinder 54. An air passage 74*a* in the bellows 74 which permits an access of the air therethrough also opens into the circular communication opening 44*a* formed in the isolation wall 44.

The liquid supply pipe 22 is connected to the top end of the filled liquid passage 48 formed within the valve housing 46, and a flow meter 24 is disposed in the liquid supply pipe 22 to detect a flow rate of the filled liquid which is fed through the liquid supply pipe 22 to be filled into the vessel 10 through the filled liquid passage 48 and the liquid valve 50.

At its one end (left end as viewed in FIG. 2), the filling valve mounting block 56 is formed with a longitudinal cylinder 56*a* in which the liquid valve opening/closing air cylinder 54 is disposed, and is also formed with a flat flange 56*b* at the other end. The flange 56*b* is secured to the isolation wall 44 which partitions between the clean environment space A disposed toward the external wall 2 and the non-purified space B open to the atmosphere within the revolving body 6.

The filler of the present embodiment represents a filler which permits a combined use with a carbonated filling operation and a non-carbonated filling operation. When a carbonated filling operation is to take place, a counter gas passage which supplies a pressurized gas (which is $CO_2$ gas in this embodiment) to the vessel 10 before a commencement of the filling operation, a gas exhaust passage which exhausts a gas from within the vessel 10 during the time the liquid is filled into the vessel 10, and a snifter passage which exhausts a gas from a head space in a vessel 10 subsequent to the completion of the filling operation are utilized. A counter gas valve 76, a gas exhaust valve 78 and a snifter valve 80 which open or close the counter gas passage, the gas exhaust passage and the snifter passage, respectively, are disposed in a block 56*c* of the filling valve mounting block 56 located between the cylinder 56*a* and the flange 56*b*.

The valve housing 46 comprises a body 46*a* which is internally formed with the filled liquid passage 48, and a liquid outlet member 82 connected to the bottom end of the body 46*a* and on which a valve seat of the liquid valve 50 which allows or interrupts the communication of the filled liquid passage 48 is formed. The liquid outlet member 82 is detachably mounted on the body 46*a* of the valve housing 46, and thus can be removed to be replaced by a separate liquid outlet member. In the embodiment shown in FIG. 2, a liquid outlet member 82 which is used for performing a carbonated filling operation (hereafter referred to as a first liquid outlet member) is mounted. Ends 84*a* and 86*a* of a pair of tubes 84 and 86 (see FIG. 4) which define passages to supply or exhaust a gas are connected to the first liquid outlet member 82. In this embodiment, the tube 84 which defines a counter gas supply passage and the ends 84*a* and 86*a* of the tube 86 which is used as a gas exhaust passage and a snifter passage in a combined manner are secured to the first liquid outlet member 82 by welding to provide an integral construction.

The end 84*a* of the counter gas supply tube 84 and the end 86*a* of the gas exhaust and snifter tube 86 which are secured to the first liquid outlet member 82 are connected through a clamp 90 to bodies 84*b* and 86*b* of the counter gas supply tube 84 and the gas exhaust and snifter tube 86 which are mounted on a mounting plate 88 secured to the bottom surface of the filling valve mounting block 56.

A passage block 92 is secured to the bottom surface of the filling valve mounting block 56, and the body 84*b* of the counter gas supply tube 84 and the body 86*b* of the gas exhaust and snifter tube 86 which are secured to the mounted plate 88 communicate through internal passages within the passage block 92 with the counter gas valve 76, the gas exhaust valve 78 and the snifter valve 80, respectively, so as to have their communication allowed or interrupted by the actuation of these valves 76, 78 and 80.

The counter gas supply tube 84 communicates with the counter gas pipe 36 through the counter gas valve 76, and the gas exhaust and snifter tube 86 communicates with the gas exhaust valve 78 and the snifter valve 80 through internal passages within the passage block 92. In addition, the gas exhaust valve 78 and the snifter valve 80 communicate with a gas exhaust tube 94 and a snifter tube 96 extending through the isolation wall 44 and through passages formed within the passage block 92. The gas exhaust tube 94 and the snifter tube 96 extend through the flange 56*b* of the filling valve mounting block 56 and through a circular passage opening 44*b* formed in the isolation wall 44 into the interior of the isolation wall 44. The gas exhaust tube 94 and the snifter tube 96 are connected to a bottom rotary joint 98 (see FIG. 1), and are led outside the filler through a stationary gas exhaust tube 100 and a snifter tube 102. It is to be noted that a seal ring 104 is disposed between the passage opening 44*b* formed in the isolation wall 44 and the flange 56*b* to maintain a hermetic seal across the isolation wall 44.

It is to be noted that the first liquid outlet member 82 is used for a carbonated filling operation, and accordingly, seal means (bottle mouth gasket) 106 is mounted on the bottom end of the member 82 in order to seal a mouth 10*a* of the vessel 10 during a filling operation.

It will be understood that the counter gas valve 76, the gas exhaust valve 78 and the snifter valve 80 are each driven by the air cylinder, and passages 76*a*, 78*a* and 80*a* which supply or exhaust the driving air to each air cylinder are formed within the filling valve mounting block 56 and open into the communication opening 44*a* formed in the isolation wall 44.

Figure 5:
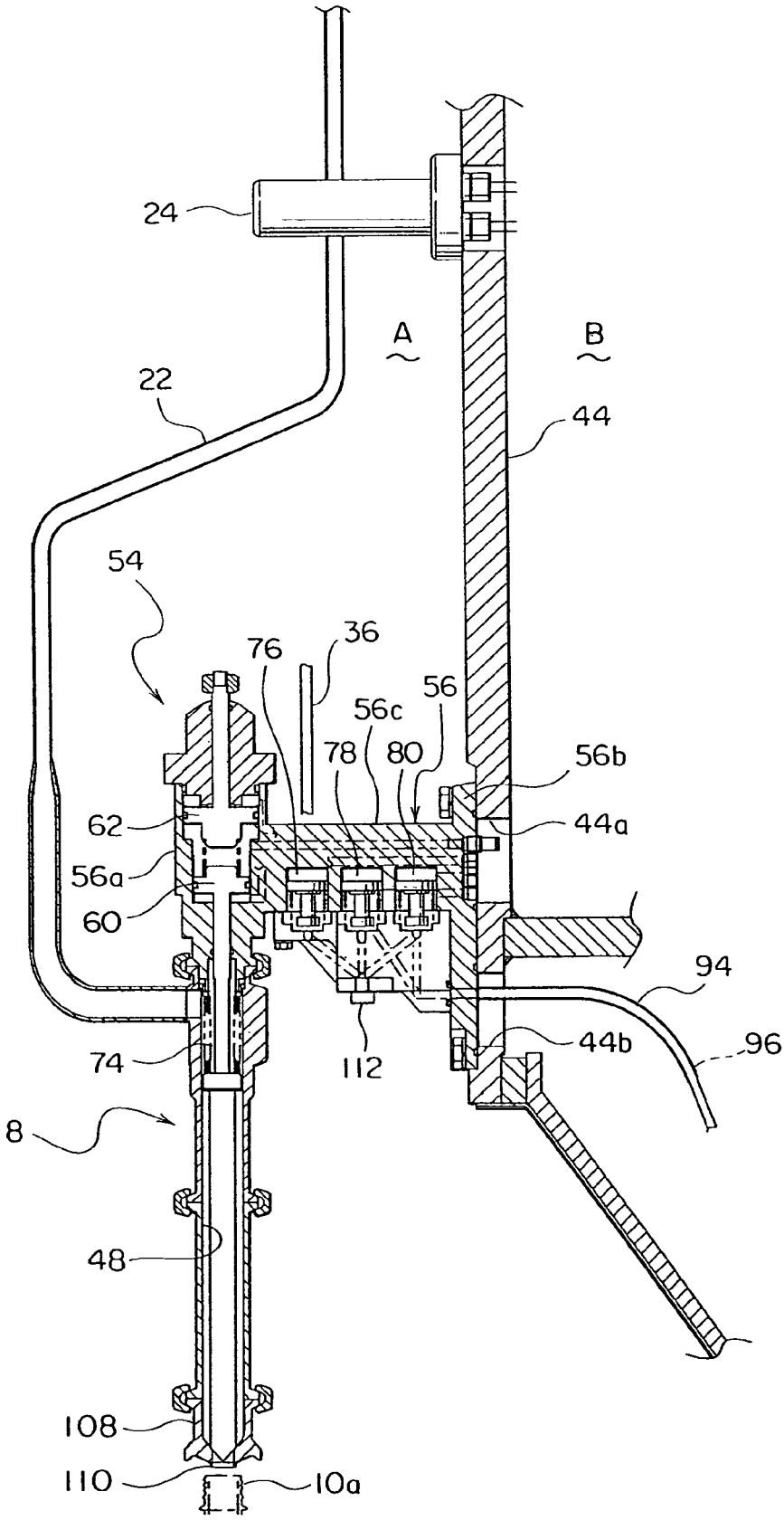
FIG. 5 is an enlarged view of a mounting portion of the filling valve, and is a longitudinal section illustrating a liquid outlet member for a non-carbonated filling operation mounted on the valve housing.

As mentioned previously, the filling valve 8 of the present embodiment permits a combined use with a carbonated filling operation and a non-carbonated filling operation. When a carbonated filling operation is to take place, the first liquid outlet member 82 having the end 84*a* of the counter gas passage tube 84 and the end 86*a* of the exhaust gas passage and snifter passage tube 86 connected thereto is mounted on the bottom end of the body 46*a* of the valve housing 46 as mentioned previously. On the other hand, when a non-carbonated filling operation is to take place, a second liquid outlet member 108 having a screen 110 mounted across a filled liquid outlet located at the lower end is mounted on the bottom end of the body 46*a* of the valve housing 46, as shown in FIG. 5. There is no need for connection with the gas exhaust passage, the counter gas passage and the snifter passage for the non-carbonated filling operation, and accordingly, the second liquid outlet member 108 simply comprises a valve seat of the liquid valve 50 which is formed on the internal surface of the liquid outlet member 108, and a screen 110 mounted on its lower surface. There is no need for the connection of the tubes 84, 86 with the passage block 92 which is secured to the lower surface of the filling valve mounting block 56, and accordingly, a lid 112 which blocks the openings of these passages is mounted in place of the mounting plate 88 (see FIG. 2) which is used during the carbonated filling operation.

Inside the external wall 2, the isolation wall 44 partitions between the clean space A located on the outside and non-purified space B located on the inside, and the spaces A and B are subject to a pressure control. In the present embodiment, the clean space A assumes a positive pressure while the non-purified space B inside the isolation wall 44 assumes an atmospheric pressure.

The operation of the filler including the filling valve 8 constructed in the manner mentioned above will now be described. When the filler is to perform a carbonated filling operation, the first liquid outlet member 82 having the end 84*a* of the counter gas supply tube 84, the end 86*a* of the gas exhaust and snifter tube 86 and the bottle mouth gasket 106 which seals the mouth 10*a* of the vessel 10 secured thereto is mounted on the bottom end of the body 46*a* of the valve housing 46 of each filling valve 8. Under this condition, the vessels 10 which are conveyed by vessel conveying means are supplied to the filler body 4 which is installed within the external wall 2, and the neck of each vessel is held by each vessel holding means 12. As mentioned previously, the vessel holding means 12 is elevatable with respect to the turntable 42, thus ascending while holding the vessel 10. The mouth 10*a* of the vessel 10 is then held against the bottle mouth gasket 106, whereby the vessel 10 is sealed.

After the vessel 10 has been sealed, the counter valve 76 disposed within the filling valve mounting block 56 is opened, whereby pressurized $CO_2$ gas from the source is fed into the vessel 10 through the gas supply pipe 34, the top rotary joint 18 and the counter gas pipe 36 disposed in the filler body 4.

After the $CO_2$ gas is introduced into the vessel 10 and pressurized to a predetermined pressure by the counter operation, the counter valve 76 is closed, whereupon the gas exhaust valve 78 is opened to exhaust a gas from within the vessel 10 through the gas exhaust and snifter tube 86 and the gas exhaust tube 94. At a predetermined time interval after the completion of the gas exhaust operation, the liquid valve 50 of the filling valve 8 is opened to initiate a filling operation while maintaining the gas exhaust valve 78 open. The liquid valve 50 is opened or closed by the actuation of the liquid valve opening/closing air cylinder 54 which is disposed in the top portion of the filling valve 8, and the liquid valve 50 is opened to a predetermined opening or closed by introducing to or exhausting the air from the pressure chambers 68, 70 and 72 of the liquid valve opening/closing air cylinder 54 through the gas supply pipe 38 and the air supply pipe 40.

The flow meter 24 disposed in the liquid supply pipe 22 which supplies the filled liquid to the filling valve 8 determines a flow rate of the liquid which is filled into the vessel 10, and when a predetermined quantity of liquid has been filled, the liquid valve 50 is closed to complete a filling operation.

After the completion of the filling operation of the vessel 10, the snifter valve 80 disposed within the filling valve mounting block 56 is opened to provide a snifter operation, whereby a gas is exhausted from the head space within the vessel 10. By sequentially performing described operations, the filled liquid which is stored in the reservoir tank is supplied to the filling valve 8 in the filler body 4 to fill the vessel 10.

For a non-carbonated filling operation, the first liquid outlet member 82 is removed from the bottom end of the body 46*a* of the valve housing 46 while the second liquid outlet member 108 carrying the screen 110 on its lower surface is mounted instead. The mounting plate 88 on which the bodies 84*b* and 86*b* of the counter gas supply tube 84 and the gas exhaust and snifter tube 86 are connected is removed, and replaced by the lid 112. Under this condition, the mouth 10*a* of the vessel 10 is positioned slightly below the screen 110 of the second liquid outlet member 108 to form a filling operation. The filler including the filling valve according to the present embodiment permits a combined use with a filling of a carbonated beverage and a filling of a non-carbonated beverage, and can accommodate for a filling in a clean environment.

What is claimed is:

1. A filling valve used to fill a liquid into a vessel supplied including a valve housing which is internally formed with a filled liquid passage and a liquid valve which allows or interrupts a communication of the filled liquid passage, wherein the valve housing comprises a body and a separate liquid outlet member detachably mounted on the bottom end of the body, the separate liquid outlet member being integrally provided with ends of a gas exhaust passage and a counter gas supply passage, the ends of these passages being connected to a body of the gas exhaust passage and a body of the counter gas supply passage, respectively.

2. The filling valve according to claim 1, wherein the separate liquid outlet member which is connected with the gas exhaust passage is provided with seal means which is disposed in abutment against a mouth of the vessel to seal the vessel.

3. The filling valve according to claim 1, wherein a valve seat of the liquid valve is formed on each liquid outlet member.

* * * * *